US006060663A

United States Patent [19]

Hier et al.

[11] Patent Number: 6,060,663

[45] Date of Patent: May 9, 2000

[54] FOAM WIRE HARNESS WITH NON-CONTINUOUS CONVOLUTES

[75] Inventors: Michael Hier, Royal Oak; Lisa Kidd, Washington; Michael Maher, Manchester, all of Mich.

[73] Assignee: Lear Automotive Dearborn, Inc., Southfield, Mich.

[21] Appl. No.: 09/151,047

[22] Filed: Sep. 10, 1998

[51] Int. Cl.[7] ..... H01B 7/18

[52] U.S. Cl. ..... 174/110 F

[58] Field of Search ..... 174/110 R, 110 F, 174/107, 108, 102 SP

[56] References Cited

U.S. PATENT DOCUMENTS

| | | | |
|---|---|---|---|
| 1,142,094 | 6/1915 | Harsch | 174/102 SP |
| 2,845,473 | 7/1958 | Doherty | 174/108 X |
| 3,688,016 | 8/1972 | Spade | 174/110 F |
| 3,783,180 | 1/1974 | Spicer | 174/110 R |
| 4,472,598 | 9/1984 | Boyd et al. | 174/102 SP |
| 5,829,485 | 11/1998 | Fatato et al. | 138/121 |
| 5,831,215 | 11/1998 | Ziemek et al. | 174/108 |

*Primary Examiner*—Kristine Kincaid
*Assistant Examiner*—Chau N. Nguyen
*Attorney, Agent, or Firm*—MacMillan, Sobanski & Todd, LLC; A. Michael Tucker

[57] ABSTRACT

Foamed wire harnesses are provided with a jacket to protect the wires. The jackets are formed with convoluted structure to center the wires during foaming. The indented portions are spaced by full-sized portions. Also, the indented portions are noncontinuous in a circumferential direction. The non-indented portions provide protection to the encased wires by preventing movement of sheet metal or other components into the convoluted areas.

17 Claims, 2 Drawing Sheets

FOAM WIRE HARNESS WITH NON-CONTINUOUS CONVOLUTES

BACKGROUND OF THE INVENTION

This invention relates to a wire harness surrounded by a foamed jacket having convoluted structure to assist in centering the harness within a mold.

Wire harnesses are utilized in vehicles to route a plurality of wires between several locations. As known, a bundle of wires is typically routed along a path, and is to be fixed to a vehicle component. To protect the wire harness, and to provide several other benefits, recently the wire harnesses have been formed in a foam mold. A foam jacket is formed over the wire harness.

One concern that developed with the development of foamed wire harnesses is the difficulty of centering the wires within the mold during the foaming process.

It was proposed to form convolutes, or indentations into the foam jacket by continuous cylindrical structure formed in the foam mold. The cylindrical structures in the mold center the wire as the foaming operation was occurring. This proposal is disclosed for example in co-pending U.S. patent application Ser. No. 08/920,458.

As an example, it should be understood that at the convolute portions, the wire may be near the surface, if not actually exposed. With continuous or cylindrical convolutes, there may be some danger of the sheet metal or other structure moving into the conduit and abrading the wire. Some improvements to this basic convolute structure may be desirable.

SUMMARY OF THE INVENTION

In a disclosed embodiment of this invention, convolutes are formed in a foamed wire harness, and are noncontinuous along a circumferential direction of the foamed jacket. In particular, the convolutes are formed as alternated indented and full-sized structure. The use of the non-continuous convolute centers the wires while the wire harness is being foamed in the mold. On the other hand, the full-sized portions between the non-continuous indented portions, prevent sheet metal, or other portions of the vehicle from entering into the convolute and abrading the wire harness. The non-continuous convolutes reduce this possibility.

In a preferred embodiment the non-continuous convolutes are separated by full cylindrical portions. In some embodiments there are axially alternating types of non-continuous convolutes such that there is a pattern of non-continuous indented portions and separating full-sized portions.

In one embodiment there is a straight line portion in the full-sized portions which extends along the length of the jacket. This portion provides for easy foam flow as the jacket is being foamed.

Although a main feature of the convolutes is the centering of the wire during foaming, it should be understood that other benefits are provided. In particular, the convolutes protect the wire harness, reduce total weight, and lower costs since less material is utilized. Further, the pattern design provides additional flexibility to the harness.

These and other features of the present invention can be best understood from the following specification and drawings, the following of which is a brief description.

DETAILED DESCRIPTION OF THE PREFERRED EMBODIMENTS

Figure 1:
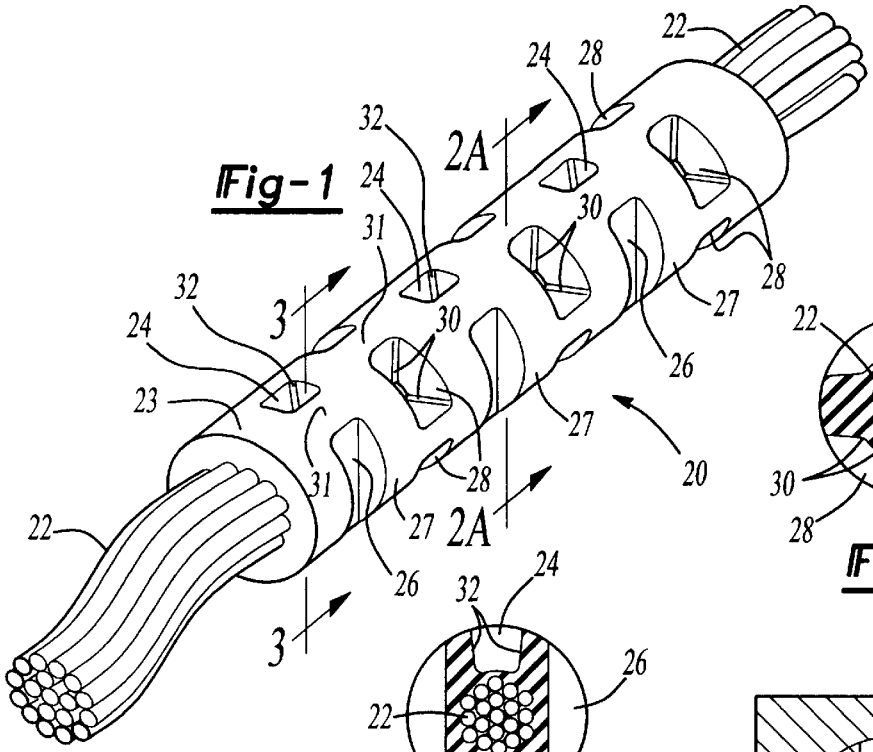
FIG. 1 shows a first embodiment wire harness.

A wire harness 20 is illustrated in FIG. 1 surrounding a bundle of wires 22. A foamed jacket 23 surrounds wires 22, and is formed in a foam mold.

Recently, the assignee of the present invention and its inventors have developed a number of improvements to foamed wire harness structures. The present invention provides benefits that could be used in combination with many of these improvements.

The present invention discloses a convolute structure for the foamed jacket that provides improvements, and in particular improvements in centering the wires 22 during the foaming of the jacket 23.

As shown, there are indented convolute portions 24 and 26 spaced by full-sized rings 27 from other convoluted portions 28. The convoluted portions 24 and 26 and adjacent convoluted portions 28 are spaced by non-indented portions 31. Thus, the convolutes as for example shown in the cross sections of 2*a* and 3 are noncontinuous in a circumferential direction.

In this way, should a sheet metal or other portion of the vehicle on which the harness 20 is mounted move against the jacket 23, the full-sized portion 31 will prevent the sheet metal or other portion from moving into the indented, or convolute portions, and abrading the wires 22.

Figure 2A:
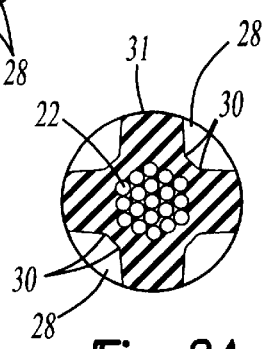
FIG. 2*a* is a cross-sectional view along line 2*a*—2*a*.

As shown in FIG. 2*a*, the non-continuous portion could include four spaced indented portions 28 spaced by the full-sized portions 31. Draft angles 30 assist the mold pins which form the indented portions 28 from moving outwardly after curing.

Figure 2B:
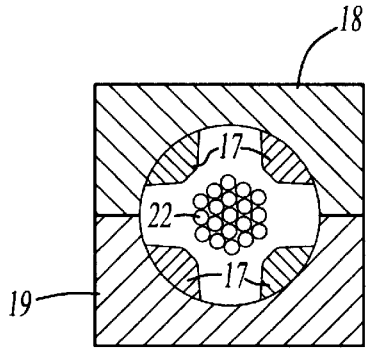
FIG. 2*b* shows a mold for forming the FIG. 2*a* structure.

FIG. 2*b* shows a molding for the jacket 23 in the location of the cross section 2*a*. As shown, a pair of spaced mold members 18 and 19 include pins 17 that will form the indented portions 28. Those pins will assist in centering the wires 22 during the foaming operation. If the wires do actually rest on the pins during foaming, the wires are still protected by the non-indented portions.

The other cross sections shown in the application below are all formed by similar mold structure.

Figure 3:
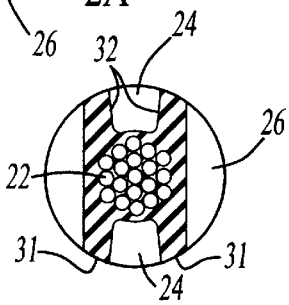
FIG. 3 is a cross-sectional view along line 3—3.

FIG. 3 shows an alternative portion wherein the indented portions 24 and 26 form distinct indented areas separated by full-sized portions 31. Again, draft surfaces 32 may be provided.

Figure 4:
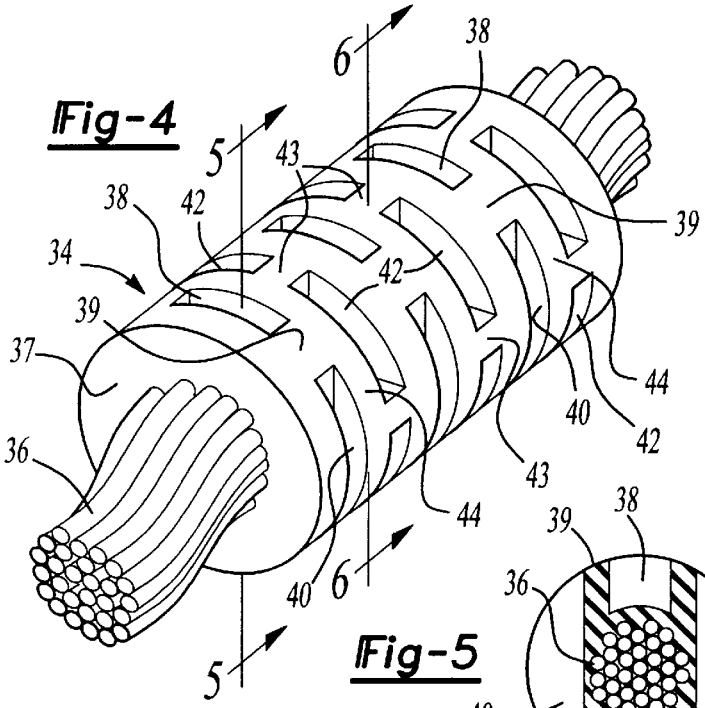
FIG. 4 is a second embodiment wire harness.

FIG. 4 shows a second embodiment 34 wherein the wires 36 are received within a jacket 37. As shown, the indented portions 38 and 40 are spaced by a full-sized portion 39. Full rings 44 separate the portions 38–40 from the axially spaced indented portions 42, downwardly. Full-sized portions 43 separate adjacent portions 42.

Figure 6:
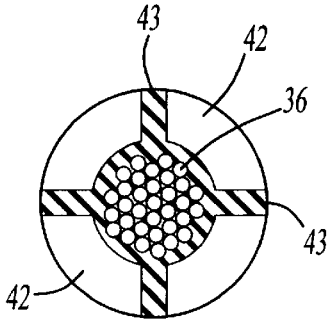
FIG. 6 is a cross-sectional view along line 6—6.
Figure 5:
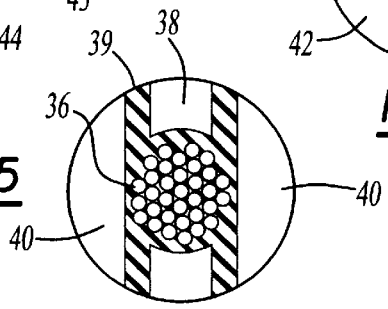
FIG. 5 is a cross-sectional view along line 5—5.

As shown in FIG. 5, the indented portions 38 and 40 are separated by the full-sized portions 39. As shown in FIG. 6, the indented portions 42 are separated by the full-sized portions 43.

In the cross sections of FIGS. 2*a*, 3, 5, 6, 8 and 9, the wires are shown beneath the surface of their respective sleeves. It should be understood that the wires may sometimes move to the surface of the indented portions, but would still be protected due to the non-indented, or full-sized, portions.

Figures 7, 8, 9:
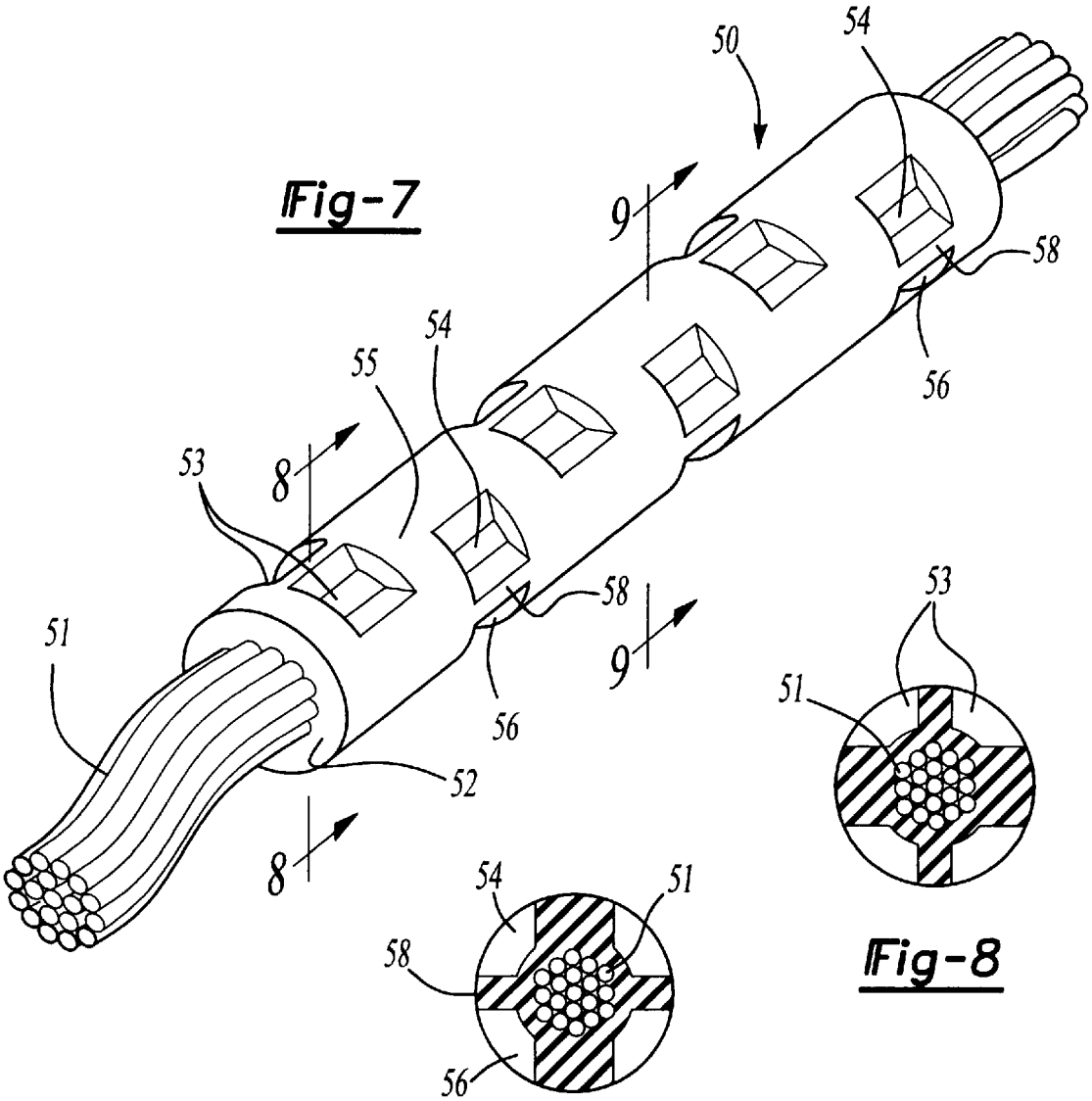
FIG. 7 is a third embodiment.
FIG. 8 is a cross-sectional view along line 8—8.
FIG. 9 is a cross-sectional view along line 9—9 of FIG. 7.

FIG. 7 shows a third embodiment of a wire harness 50, wherein the wires 51 are embedded in a jacket 52. Indented portions 53 and 54 are spaced by full-sized rings 55.

A straight line full-sized portion 58 is formed between all of the indented portions along the length of the jacket 52. The straight line portion assists in flow of the foaming material in the mold. Without straight line portions, the several mold pins which form the indented portions could present a torturous path preventing the foam from moving through the mold. The straight line portion provides an easy path for flow for the foaming material during injection of the foam into the mold.

FIGS. 8 and 9 show the shape of the sleeve 52 at the cross sections of line 8—8 and 9—9, respectively.

The use of the alternating sections provides a sleeve wherein the indented portions are not aligned, and thus, it is less likely that a sheet metal part or other part of the vehicle can move into the indented portions and actually contact the vehicle. The several full-sized portions block the sheet metal portion from moving into the indented portions.

Known foams are utilized to form the foamed wire harness.

Although preferred embodiments have been disclosed, a worker in this art would recognize that modifications would come within the scope of this invention. For that reason the following claims should be studied to determine the true scope and content of this invention.

What is claimed is:

1. A wire harness comprising:

a plurality of wires extending generally along an axis; and a foam jacket surrounding, in contact with, and foamed onto said plurality of wires;

said jacket including axially alternating full-sized rings and indented portions, said indented portions having a smaller cross section than said full-sized rings; said indented portions being noncontinuous about a circumferential direction and circumferentially spaced apart by non-indented portions.

2. A wire harness as recited in claim 1 wherein said jacket is generally cylindrical.

3. A wire harness as recited in claim 1 wherein said indented and non-indented portions include first and second patterns, said first pattern having first said indented portions circumferentially spaced by first said non-indented portions, said first pattern axially spaced along said wire harness from said second pattern having second said indented portions circumferentially spaced by second said non-indented portions.

4. A wire harness as recited in claim 3 wherein said second pattern is different from said first pattern.

5. A wire harness as recited in claim 3 wherein indented portions of the first pattern are not aligned with indented portions of the second pattern.

6. A wire harness as recited in claim 3 wherein indented portions of the first pattern include draft surfaces and indented surfaces of the second pattern include draft surfaces.

7. A wire harness as recited in claim 1 wherein a full-sized area formed by said full-sized rings and said non-indented portions extends along an entire axial length of said jacket for a limited circumferential extent.

8. A wire harness as recited in claim 1 wherein said indented portions include a plurality of indented subareas, with some of said subareas extending for a greater surface area than others.

9. A wire harness as recited in claim 8 wherein said some subareas include areas wherein radially outermost edges of said jacket are removed over a first circumferential extent, and said others include areas which are removed over a second circumferentially extent, with said second circumferential extent being less than said first circumferential extent.

10. A wire harness as recited in claim 8 wherein said subareas are all indented over an approximately equal circumferential extent.

11. A wire harness as recited in claim 1 wherein a pair of adjacent indented portions are different from one another.

12. A wire harness as recited in claim 1 wherein the indented portions include draft surfaces.

13. A wire harness comprising:

at least one wire;

a jacket surrounding and in contact with the wire; and first and second patterns of indented portions and non-indented portions circumferentially aligned about the jacket, wherein the second pattern is axially spaced along the jacket from the first pattern, wherein said indented portions of the first pattern are not aligned with said indented portions of the second pattern.

14. The wire harness specified in claim 13 wherein the second pattern is different from the first pattern.

15. The wire harness specified in claim 13 wherein a full-sized ring is provided between the first and second patterns.

16. The wire harness specified in claim 15 wherein a full-sized area extends between the first and second patterns.

17. The wire harness specified in claim 13 wherein the indented portions include draft surfaces.

* * * * *